United States Patent [19]

Doane

[11] 4,100,912

[45] Jul. 18, 1978

[54] PORTABLE CAMP STOVE

[76] Inventor: Tuthill Doane, 373 School St., Westbury, N.Y. 11590

[21] Appl. No.: 705,773

[22] Filed: Jul. 16, 1976

[51] Int. Cl.[2] ..... F24C 15/08

[52] U.S. Cl. ..... 126/43; 113/116 HH; 126/9 A; 126/50; 211/73; 248/300; 248/311.1 R

[58] Field of Search ..... 126/43, 50, 9 A , 9 B, 126/305, 306; 248/152, 174, 300, 311.1, 314; 211/73; 113/116 EE, 116 HH, 116 V; 229/42

[56] References Cited

U.S. PATENT DOCUMENTS

| | | | |
|---|---|---|---|
| 749,647 | 1/1904 | Walsh | 126/9 A X |
| 1,173,207 | 2/1916 | Murray | 126/43 |
| 1,310,830 | 7/1919 | Hothersall | 126/43 |
| 1,810,836 | 6/1931 | Laubenstein | 248/300 X |
| 2,112,747 | 3/1938 | Wood | 113/116 V |
| 3,565,326 | 2/1971 | Turkovich | 229/42 |
| 3,974,911 | 8/1976 | Graser | 206/193 |

FOREIGN PATENT DOCUMENTS

| | | | |
|---|---|---|---|
| 638,983 | 6/1928 | France | 248/311.1 |
| 371,078 | 5/1939 | Italy | 248/174 |
| 512,024 | 8/1939 | United Kingdom | 126/43 |

*Primary Examiner*—William F. O'Dea
*Assistant Examiner*—Harold Joyce

[57] ABSTRACT

A portable camp stove for supporting a container of cooking fuel above a given plane and a cooking utensil over said container, said stove comprising a flat blank of bendable sheet metal having portions defining a container support, a first side member and a second side member, said side members connected to said support at bending lines.

The stove is erected by bending each side member with respect to the support along the bending lines wherein, during use, the container rests upon the support and the utensil is placed on the side members over the fuel container.

9 Claims, 6 Drawing Figures

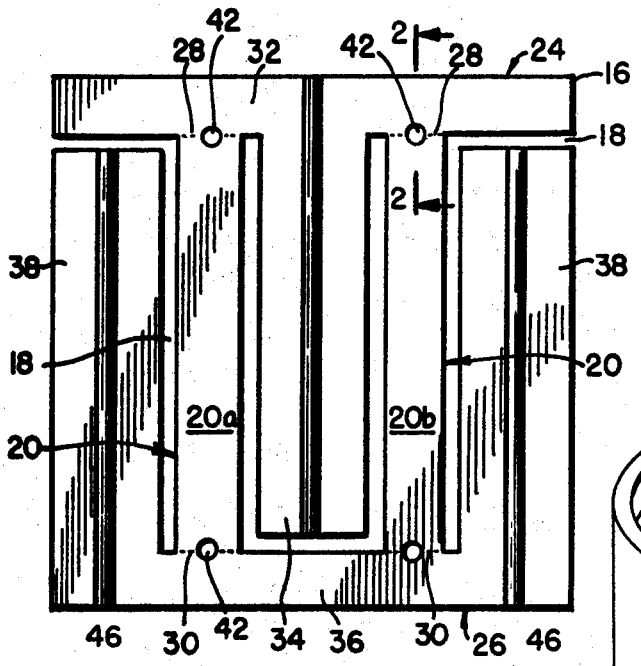
FIG. 1
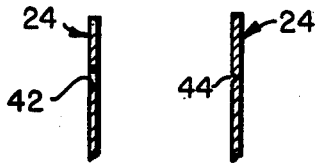
FIG. 2A FIG. 2B
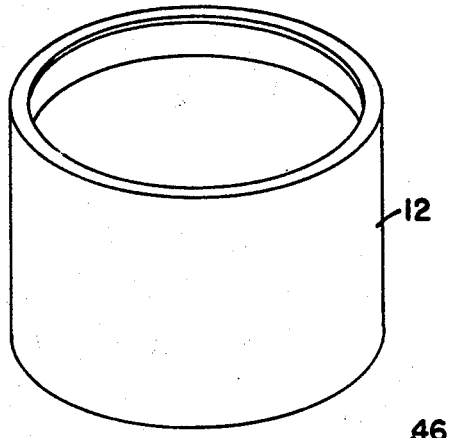
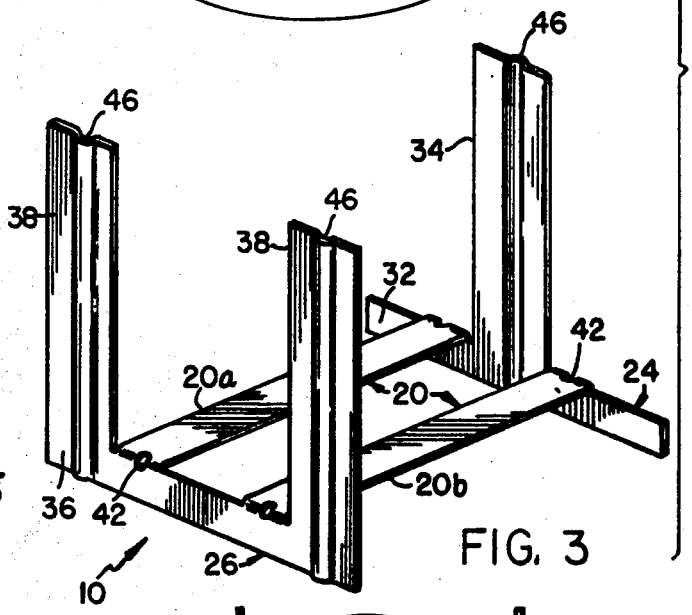
FIG. 3
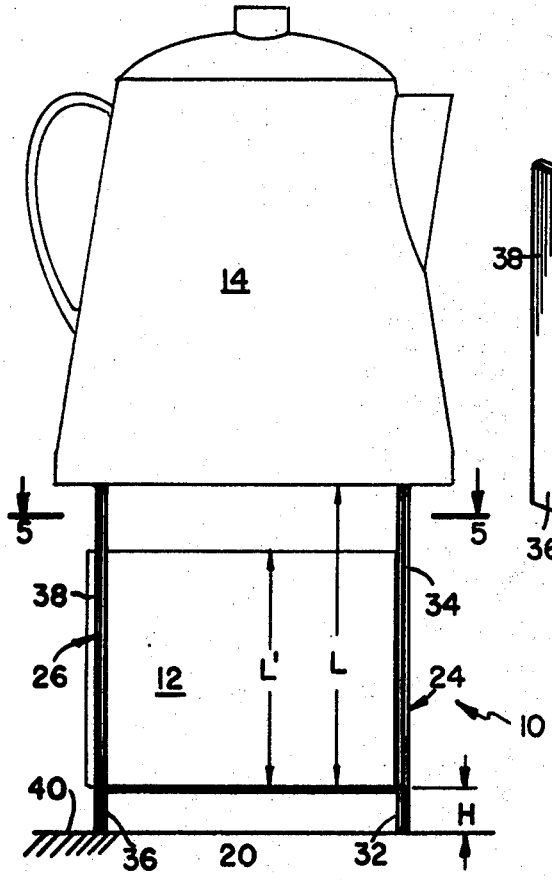
FIG. 4
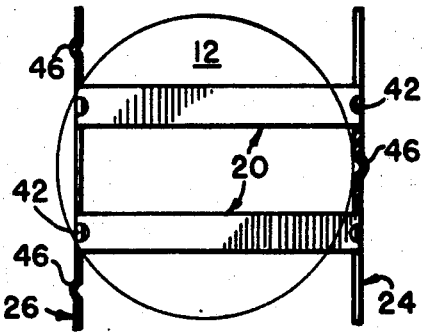
FIG. 5

PORTABLE CAMP STOVE

BACKGROUND OF THE INVENTION

The present invention relates to portable camp stoves.

Camp stoves are known in the prior art. These are generally of a type using a can of chemical fuel such as that made by Sterno, Inc. These have the disadvantage of not retaining the fuel container above a given plane, requiring the use of tools for assembly and not being an integral unit. One such prior art stove is made by Sterno, Inc. This two-part device requires assembly using a pair of pliers. Thus assembled, it rests on top of the container with no portion of theis device situated between the container and the plane upon which it rests.

SUMMARY OF THE INVENTION

It is the principle object of this invention to provide a low cost portable camp stove that can be easily erected from a one piece metal blank without the use of tools.

A further object is to provide a stove that will support a container of cooking fuel above the surface upon which the stove rests to prevent the container from transmitting heat directly to the surface.

A still further object is to provide a rigid support for a cooking utensil extending above the top of the fuel container.

A still further object is to permit partial or complete covering of the fuel container for reducing or extinguishing the cooking flame without the necessity of handling any part of the stove that may be hot.

These and other objects are achieved by the preferred embodiment of the present invention in which a single flat blank of sheet metal is punched and pierced to form portions that can be erected to support the fuel container above a given plane and support a utensil thereover. The stove blank can be erected without tools since the material is of a bendable grade and holes or stamped creases can be disposed at the bending lines to reduce the bending effort without weakening the stove. Rigidizing ribs can be embossed into the utensil support for carrying relatively heavy loads without deforming.

Having in mind the above and other objects that will be obvious from an understanding of the disclosure, the present invention comprises an arrangement of parts illustrated in the presently preferred embodiments of the invention which are hereinafter set forth in sufficient detail to enable those persons skilled in the art to clearly understand the function, operation, construction and advantages of it when read in conjunction with the accompanying drawing.

BRIEF DESCRIPTION OF THE DRAWING

The invention will be described in detail, by way of example, by reference to the accompanying drawing in which:

FIG. 1 is a developed view of the preferred embodiment of the invention;

FIG. 2A is a sectional view taken along line 2—2 in FIG. 1;

FIG. 2B is a sectional view of an alternative embodiment;

FIG. 3 is a pictorial view of the stove;

FIG. 4 is an elevational view of the stove; and

FIG. 5 is a sectional plan view of the stove taken along line 5—5 in FIG. 4.

DETAILED SESCRIPTION OF THE INVENTION

Referring to the FIGS. 3 and 4 of the drawing, and in accordance with the principles of the invention, a portable camp stove 10 for supporting, during use, a container of cooking fuel 12 and a cooking untensil 14 is shown. The stove 10 is formed from a flat blank 16 of bendable sheet metal as shown in FIG. 1. The sheet metal is preferably composed of an aluminum alloy, preferably a sheet of 0.8 millimeter thickness (1/32 inch) of alloy 5052 having a ¼ hard temper. Alternatively, a commercial grade of cold rolled steel can be used.

The blank 16 has an array of elongated slots 18 punched therein to delineate a container support 20 comprising a pair of equal and spaced apart rectangular strips **20*a*, 20*b* having their longer sides disposed parallel to each other. Also defined by the slots 18 are a first side member 24 and a second side member 26, each connected to the shorter sides of strips 20*a*, 20*b* along parallel bending lines 28 and 30 respectively. The first side member 24 is T-shaped, the cap of which corresponds to first portion 32 and the leg to a second portion 34 which is disposed between the strips 20*a*, 20*b* and parallel to inner edges thereof. Bending lines 28 separate the portions 32, 34 and are symmetrically disposed with respect to the second portion 34**.

The second side member 26 is U-shaped, the base of which corresponds to a first portion 36 and the arms to a second portion 38 which are disposed parallel and adjacent to outer edges of the strips **20*a*, 20*b*. Bending lines 30 separate portions 36, 38 and are symmetrically disposed with respect to the second portion 38**.

The stove 10 is erected by inwardly bending the first and second side members 24, 26 along their respective bending lines 28, 30 disposing them each substantially perpendicular to the support 20 with the first portions 32, 36 each disposed below the support 20 and the second portions 34, 38 each disposed thereabove. Each first portion 32, 36 has a height H equal to the distance the support 20 is positioned above a given plane 40 as shown in FIG. 4 and each second portion has a length L which is greater than the height L′ of the fuel container 12, thereby allowing the upper edges of the second portion 34, 38 to support a cooking utensil 14 above the top of the container 12.

To facilitate bending by hand, apertures 42 may be punched through the blank 16 across each bending line 28, 30 as shown in FIGS. 1 and 2A thereby reducing the bending area. Alternatively, a crease 44 may be stamped into one side of the blank 16 as shown in FIG. 2B to reduce the thickness at the bending lines 28, 30.

The upper portions 34, 38 can be disposed to closely receive the fuel container 12 as shown in FIG. 5. This proximity serves to restrain the upper portions 34, 38 from bending in one direction under the weight of the utensil 14. These portions can be rigidized by embossing U-shaped sections 46 into each second portion 34, 38 parallel to their longer axis, the embossment continuing through the associated first portions 32, 36 to the edge of the blank 16. The cross-section of the embossed second portions 34, 38 has a greater area moment of inertia than a flat section and therefore offers increased resistance to bending.

While preferred and other exemplary embodiments of the invention are illustrated and/or described, it will be understood that the invention is in no way limited to these embodiments.

What is claimed is:

1. In combination: a container of cooking fuel having a given height and a portable camp stove for supporting the container during use above a given plane and a cooking utensil over said container, said stove comprising:

a flat blank of bendable sheet metal or the like having means defining elongated slots therein for delineating (i) a container support, (ii) a first side member connected to said support along at least one first bending line and having a first portion disposed on one side of said first bending line and a second portion disposed on the other side of said first bending line and (iii) a second side member connected to said support along at least one second bending line and having a first portion disposed on one side of second bending line and a second portion disposed on the other side of said second bending line, wherein the second portions of each of said side members have a length greater than said given height and are disposed parallel to each other and configured to closely receive said container therebetween when the stove is erected and said container rests upon said support; and wherein said stove is erected by inwardly bending said first and second side members with respect to said container support along said first and second bending lines respectively, disposing each side member substantially perpendicular to said support wherein said first portions of said side members are positioned below said support for disposing the support above the given plane and wherein said second portions of said side members are simultaneously disposed above said support while maintaining the coplanar relationship between said first and second portion of each side member for supporting a utensil placed thereon over said support and thereby over said fuel container resting thereon.

2. The combination as recited in claim 1, further comprising means for rigidizing said second portions of said side members.

3. The combination as recited in claim 2, wherein said rigidizing means includes at least one elongated U-shaped section embossed into each second portion and parallel to the longer axis thereof and continuing into the first portion associated with said second portion to the edge of the blank.

4. The combination as recited in claim 1, further comprising means for facilitating bending of said side members.

5. The combination as recited in claim 4, wherein said bending means comprises means defining at least one aperture in each bending line.

6. The combination as recited in claim 4, wherein said bending means comprises means defining a depression stamped into one side of said blank coincident with each bending line.

7. The combination as recited in claim 1, wherein said bendable sheet metal comprises aluminum alloy.

8. The combination as recited in claim 1, wherein said bendable sheet metal comprises steel.

9. A portable camp stove for supporting, during use, a container of cooking fuel above a given plane and a cooking utensil over said container, said stove comprising:

a flat blank of bendable sheet metal or the like having means defining elongated slots therein for delineating (i) a container support comprising a pair of equal and spaced apart rectangular strips having longer sides in parallel disposition;

(ii) a first side member connected to said support along at least one first bending line and having a first portion disposed on one side of said first bending line and a second portion disposed on the other side of said first bending line, wherein said first side member is T-shaped, the leg portion thereof corresponding to said second portion and disposed between said rectangular strips and parallel to inner edges thereof, and the cap portion of said T-shaped member corresponding to said first portion and connected symmetrically about the leg portion to adjacent shorter sides of said rectangular strips; and (iii) a second side member connected to said support along at least one second bending line and having a first portion disposed on one side of second bending line and a second portion disposed on the other side of said second bending line, wherein said second side member is U-shaped, the arm portions thereof corresponding to said second portion and each disposed parallel and adjacent to one of the outer edges of said rectangular strips and the base portion thereof corresponding to said first portion and connected symmetrically about the arm portions to opposite adjacent shorter ends of said rectangular strips, wherein said stove is erected by inwardly bending said first and second side members with respect to said container support along said first and second bending lines respectively, disposing each side member substantially perpendicular to said support wherein said first portions of said side members are positioned below said support for disposing the support above the given plane and wherein said second portions of said side members are disposed above said support for supporting said utensil placed thereon over said support and thereby over said fuel container resting thereon.

* * * * *